US007294047B1

(12) United States Patent
Lin

(10) Patent No.: US 7,294,047 B1
(45) Date of Patent: Nov. 13, 2007

(54) SANDER DEVICE

(76) Inventor: Kun Yi Lin, No. 261, Sec. 1, Liaonin Road, Beitun, Taichung (TW) 40675

( * ) Notice: Subject to any disclaimer, the term of this patent is extended or adjusted under 35 U.S.C. 154(b) by 0 days.

(21) Appl. No.: 11/590,730

(22) Filed: Oct. 31, 2006

(51) Int. Cl.
*B24B 21/00* (2006.01)

(52) U.S. Cl. ..... 451/296; 451/310

(58) Field of Classification Search ..... 451/296, 451/300, 301, 297, 65, 489, 310, 311, 360, 451/361

See application file for complete search history.

(56) References Cited

U.S. PATENT DOCUMENTS 2,763,972 A * 9/1956 White ..... 451/456
5,199,220 A * 4/1993 Steiner et al. ..... 451/65
6,089,958 A 7/2000 Costa et al. ..... 451/59
6,468,140 B1 * 10/2002 Wang ..... 451/310
6,533,649 B2 3/2003 Wang ..... 451/310
6,733,372 B2 * 5/2004 Lin ..... 451/65
6,854,401 B2 2/2005 Lin ..... 108/143
6,899,606 B2 * 5/2005 Liao et al. ..... 451/184
7,090,571 B1 * 8/2006 Wang ..... 451/296
7,112,126 B1 * 9/2006 Wang ..... 451/301

* cited by examiner

*Primary Examiner*—Joseph J. Hail, III
*Assistant Examiner*—Anthony Ojini
(74) *Attorney, Agent, or Firm*—Charles E. Baxley

(57) ABSTRACT

A sander device includes a housing pivotally attached to a supporting base and rotatable between a horizontal position and a vertical position, a driven roller and an idle roller rotatably disposed in the housing, and an endless driving belt engaged over the driven roller and the idle roller and also rotatable between the horizontal position and the vertical position together with the housing, a table is used for supporting the work piece, and a moving device may support and move the table and the work piece to the sanding belt when the driving belt is located at either the horizontal position or the vertical position. An actuating device is attached the housing for selectively forcing the driving belt to sand the work piece.

18 Claims, 13 Drawing Sheets

SANDER DEVICE

BACKGROUND OF THE INVENTION

1. Field of the Invention

The present invention relates to a belt sander device, and more particularly to a belt sander device including a sanding belt adjustable between a horizontal position and a vertical position, and a feeding table for supporting and/or feeding the work pieces through the sanding belt when the sanding belt is either in the horizontal position or in the vertical position.

2. Description of the Prior Art

Typical belt sander devices comprise a sanding belt entrained around a driven roller and an idle roller, and a driving motor coupled to the driven roller for rotating or driving the sanding belt to sand or to grind the work pieces.

For example, U.S. Pat. No. 6,089,958 to Costa et al. discloses one of the typical belt sanders with orbitally translated abrasive belt and also comprising a driving motor coupled to a driven roller for rotating or driving a sanding belt to sand or to grind the work pieces, and a pair of eccentric shafts for driving and adjusting or imparting translational orbital movement to a sanding head, and a feed belt for supporting the work pieces and for feeding the work pieces through the sanding belt.

However, the sanding belt may not be adjusted between a horizontal position and a vertical position, in addition, the feed belt may not be used to support and to feed the work pieces through the sanding belt when the sanding belt is either in the horizontal position or in the vertical position.

U.S. Pat. No. 6,533,649 to Wang discloses another typical belt sander assemblies having sander member and comprising a frame pivotally or rotatably attached to a supporting base for adjustably supporting a sander belt, and a platform for supporting the work pieces.

However, the platform may only be used for supporting the work pieces but may not be used for feeding the work pieces through the sander belt. The users have to move the work pieces through the sander belt by themselves. In addition, when the sander belt is rotated and adjusted to a horizontal position, the platform may no longer be useful for supporting the work pieces.

U.S. Pat. No. 6,854,401 to Lin discloses a typical working table having a stable support for supporting the work pieces, and having a table movable up and down by a rack.

However, the table may not be used for supporting the work pieces when the sander belt is rotated and adjusted between a horizontal position and a vertical position.

The present invention has arisen to mitigate and/or obviate the afore-described disadvantages of the conventional arrangements of the sander devices.

SUMMARY OF THE INVENTION

The primary objective of the present invention is to provide a sander device including a sanding belt adjustable between a horizontal position and a vertical position, and a feeding table for supporting and/or feeding the work pieces through the sanding belt when the sanding belt is either in the horizontal position or in the vertical position.

In accordance with one aspect of the invention, there is provided a sander device comprising a supporting base, a housing pivotally attached to the supporting base and rotatable relative to the supporting base between a horizontal position and a vertical position, a driven roller and an idle roller rotatably disposed in the housing, and an endless driving belt engaged over the driven roller and the idle roller, and a driving motor coupled to the driven roller for rotating and driving the sanding belt to sand a work piece, the driving belt also rotatable relative to the supporting base between the horizontal position and the vertical position together with the housing, a table for supporting the work piece, and a moving device for moving and supporting the table and the work piece relative to the sanding belt and the supporting base when the driving belt is located at either the horizontal position or the vertical position.

A shield is further provided and pivotally hinged to the supporting base and rotatable relative the supporting base to selectively cover and shield the sanding belt when the sanding belt is located at the vertical position.

The housing includes a cover hinged to the housing and rotatable relative to the housing for selectively opening and exposing the sanding belt and for allowing the sanding belt to sand the work piece when the sanding belt is located at the vertical position.

The housing includes at least one hose coupled to the housing for vacuuming and drawing sand dusts generated during a sanding operation. The housing includes at least one hood hinged to the housing for covering and shielding one side portion of the housing. The hood includes a curved groove formed therein, and a fastener attached to the housing and engaged with the curved groove of the hood for adjustably securing the hood to the housing.

The moving device includes two followers slidably attached to the supporting base and movable up and down relative to the supporting base for supporting the table. The supporting base includes two chains attached thereto and coupled to the followers for moving the followers up and down relative to the supporting base.

The supporting base includes two pairs of sprockets attached thereto and coupled to the chains, and a hand wheel rotatably attached to the supporting base and coupled to one of the sprockets for driving the chains and for moving the followers relative to the supporting base.

A link is further provided and coupled between two of the sprockets for coupling the chains together. Two casings are attached to the supporting base for receiving the sprockets and the chains. The table includes at least one stop attached to the table for engaging with the work piece and for anchoring the work piece to the table.

Two poles are further provided and slidably attached to the followers and coupled to the table for allowing the table to be moved forwardly and rearwardly relative to the supporting base with the poles. The poles are slidably attached to the followers with at least one bracket and at least one roller.

The supporting base includes at least one rod attached to the supporting base for supporting a stop which may engage with the work piece for anchoring the work piece to the supporting base. An actuating device is further provided and attached the housing for selectively forcing and pressing the driving belt to sand the work piece.

The actuating device includes a shaft attached to the housing, a sliding member slidably attached to the shaft, an arm hinged to the sliding member and extended through the driving belt, and an actuating member hinged to the arm for being moved to engage with the driving belt.

The arm includes a weight member attached to an extension of the arm for elevating and disengaging the actuating member from the driving belt. A retainer is further provided and attached to the housing for selectively engaging with the extension of the arm and for anchoring and positioning the arm to the housing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
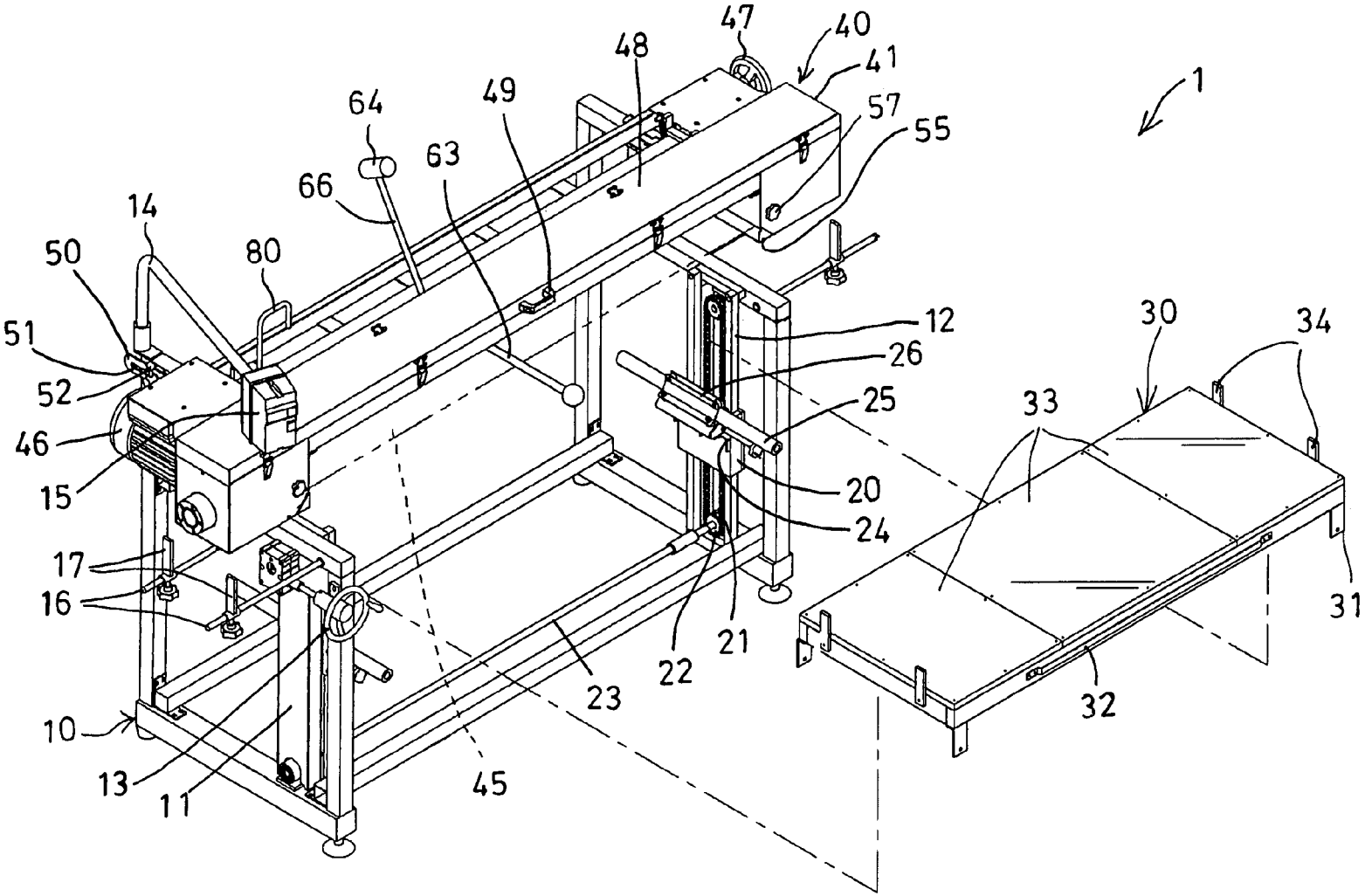
FIG. 1 is a partial exploded view of a sander device in accordance with the present invention.

Referring to the drawings, and initially to FIGS. 1-5, a sander device 1 in accordance with the present invention comprises a supporting base 10 including two casings 11, 12 attached to the opposite side portions of the supporting base 10 for supporting a moving or adjusting means or device 20. The adjusting means or device 20 includes two gears or pulleys or sprockets 22 rotatably attached to the upper portion and the lower portion of each of the casings 11, 12 respectively and a chain 21 engaged over or around the sprockets 22 of each of the casings 11, 12, and a link 23 coupled between the two lower sprockets 22 that are attached to the lower portions of the casings 11, 12 for coupling the chains 21 together and for allowing the chains 21 to be moved in concert with each other.

The adjusting means or device 20 further includes a follower 24 attached or coupled to the chain 21 of each of the casings 11, 12, and arranged for allowing the followers 24 to be slidably attached to and movable up and down along the casings 11, 12 or relative to the supporting base 10 by the chains 21. A hand wheel 13 is rotatably attached to the supporting base 10 and coupled to one of the sprockets 22 for manually driving the chains 21 and for moving or adjusting the followers 24 along the casings 11, 12 or relative to the supporting base 10. An elbow 14 may be pivotally or rotatably attached to the supporting base 10 for adjustably supporting such as a control box or device 15 thereon. One or more rods 16 may further be provided and attached to the supporting base 10, and each for supporting a stop 17 which may be engaged with the work pieces 8 (FIGS. 7, 8) for anchoring the work pieces 8 to the supporting base 10.

The adjusting means or device 20 further includes a pole 25 slidably attached or coupled to each of the followers 24 with one or more brackets 26 and one or more wheels or rollers 27 (FIGS. 4, 5) for allowing the poles 25 to be moved forwardly and rearwardly relative to the supporting base 10. A table 30 includes one or more ears 31 extended downwardly therefrom for attaching or securing to the poles 25 with such as fasteners or latches (not shown) for allowing the table 30 to be moved forwardly and rearwardly relative to the supporting base 10 with the poles 25, and includes a handle 32 attached to the front portion thereof for being held or grasped by the users to move the table 30 forwardly and rearwardly relative to the supporting base 10.

The table 30 may include one or more table members 33 foldably or detachably secured together for such as folding to a compact storing configuration, and may include one or more further pivotal or foldable stops 34 (FIGS. 1, 3, 9-10, 13-16) attached or coupled to the table 30 for engaging with the work pieces 8 (FIG. 14) and for anchoring the work pieces 8 to the table 30. The table 30 may be used for supporting the work pieces 8 (FIGS. 7-12, 14-15), and may be moved up and down relative to the supporting base 10 by the adjusting means or device 20, and may be moved forwardly and rearwardly relative to the supporting base 10 with the handle 32 and thus for allowing the table 30 and the work pieces 8 to be moved toward or away from a sanding device 40.

The sanding device 40 includes a housing 41 pivotally or rotatably attached to the supporting base 10 with a pivot axle 42 (FIGS. 14-16) for allowing the housing 41 pivoted or rotated relative to the supporting base 10 from or between one position or horizontal position (FIGS. 1-3, 6-12) and the other position or vertical position (FIGS. 13-15), a driven roller 43 and an idle roller 44 rotatably disposed in and attached to the housing 41 (FIGS. 7-8, 11-12), and an endless driving belt 45 engaged over or around the driven roller 43 and the idle roller 44, and a driving motor 46 coupled to the driven roller 43 for rotating or driving the sanding belt 45 to sand or to grind the work pieces 8. Another hand wheel 47 may be rotatably attached to the housing 41 and coupled to the driven roller 43 or the idle roller 44 for adjusting or stretching the sanding belt 45.

In operation, as shown in FIGS. 7-12, the sanding belt 45 may be supported on the horizontal position, and the work pieces 8 may be moved up and down relative to the supporting base 10 or relative to the sanding belt 45 with the table 30 and by the adjusting means or device 20 for allowing the sanding belt 45 to sand or grind the upper portion of the work pieces 8. Alternatively, as shown in FIGS. 13-15 and 17, when the housing 41 is rotated relative to the supporting base 10 to other position or to the vertical position, the work pieces 8 may be moved forwardly and rearwardly relative to the supporting base 10 or moved rearwardly toward the sanding belt 45 with the table 30 for allowing the sanding belt 45 to sand or grind the rear or side portion of the work pieces 8.

Figure 2:
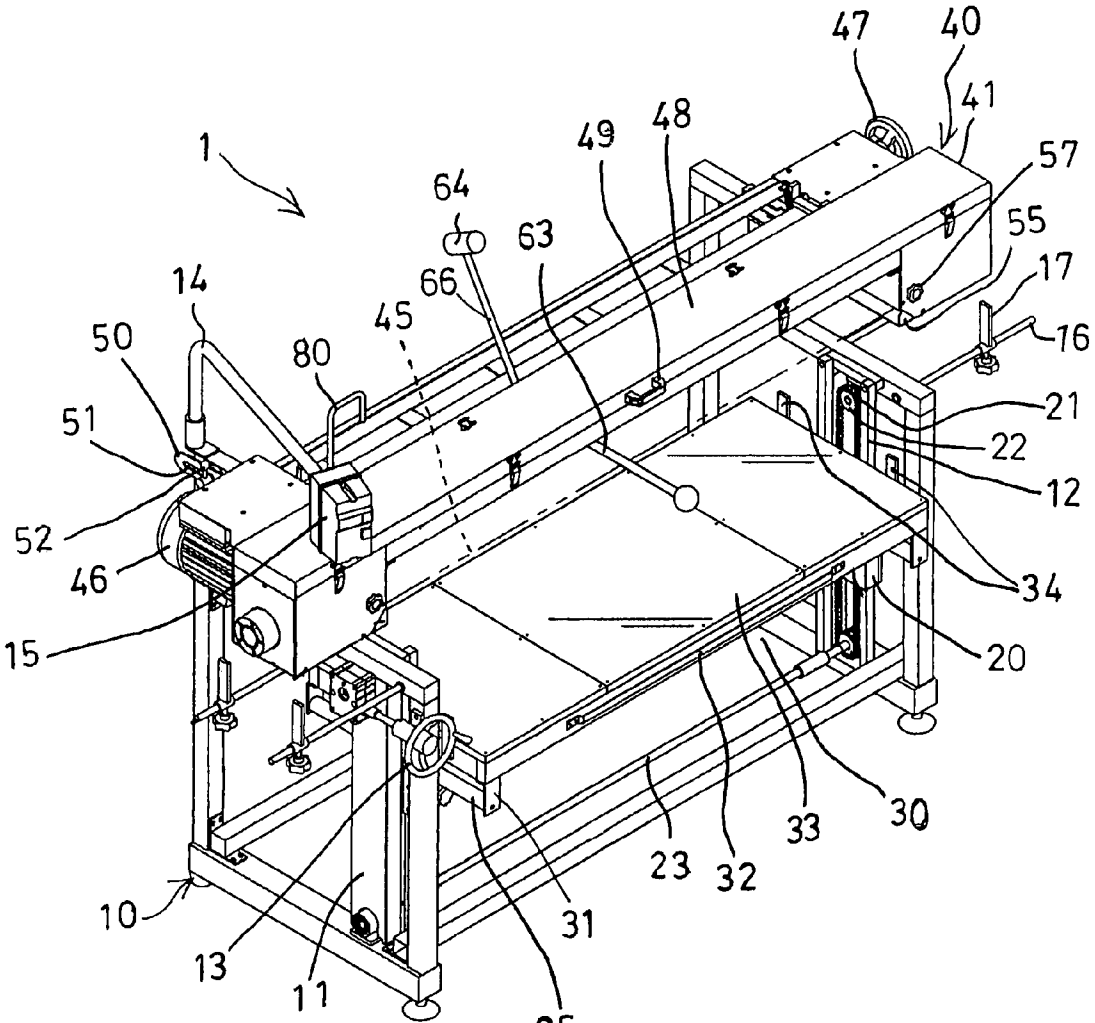
FIG. 2 is a perspective view of the sander device.
Figure 3:
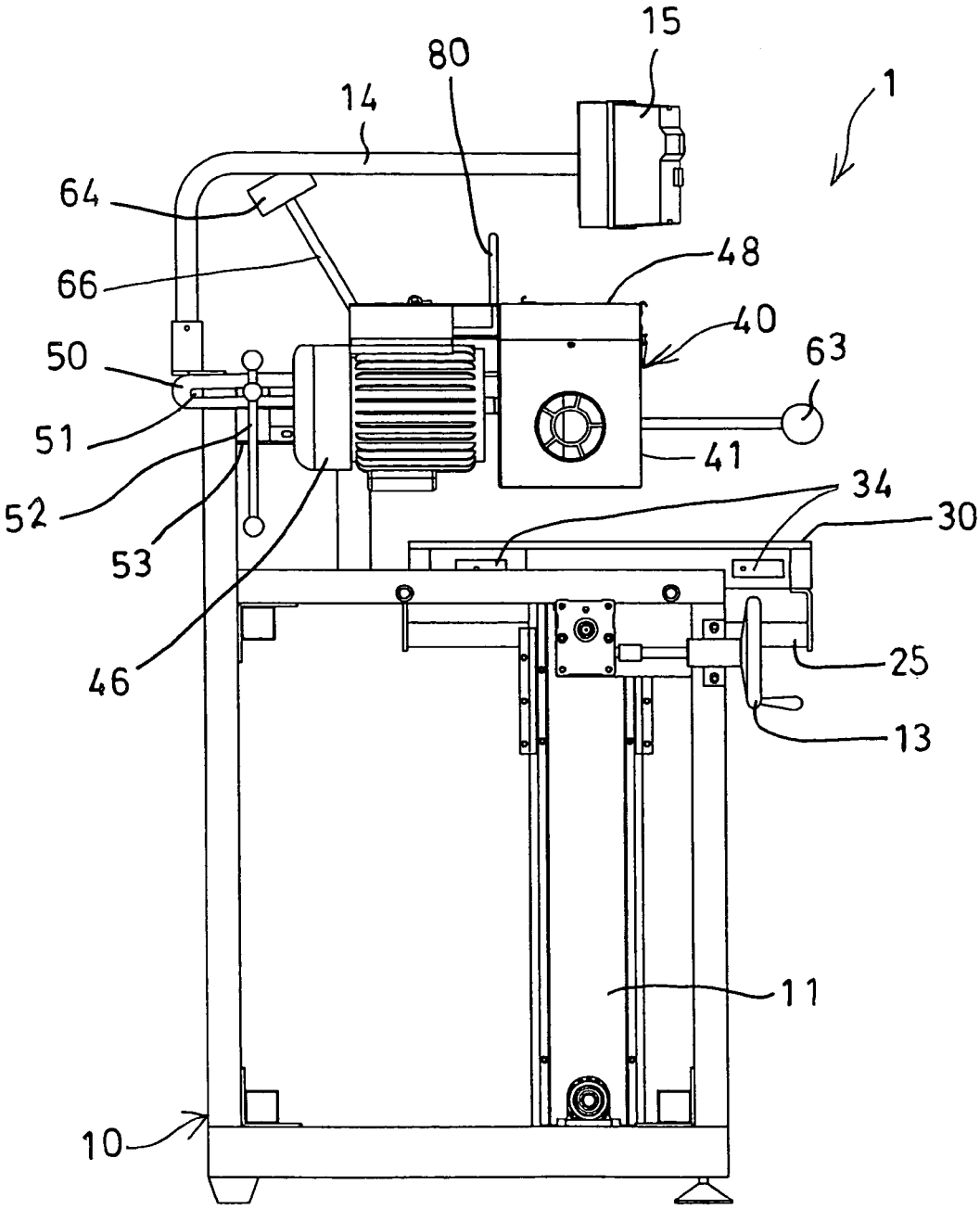
FIG. 3 is a side plan schematic view of the sander device.
Figure 4:
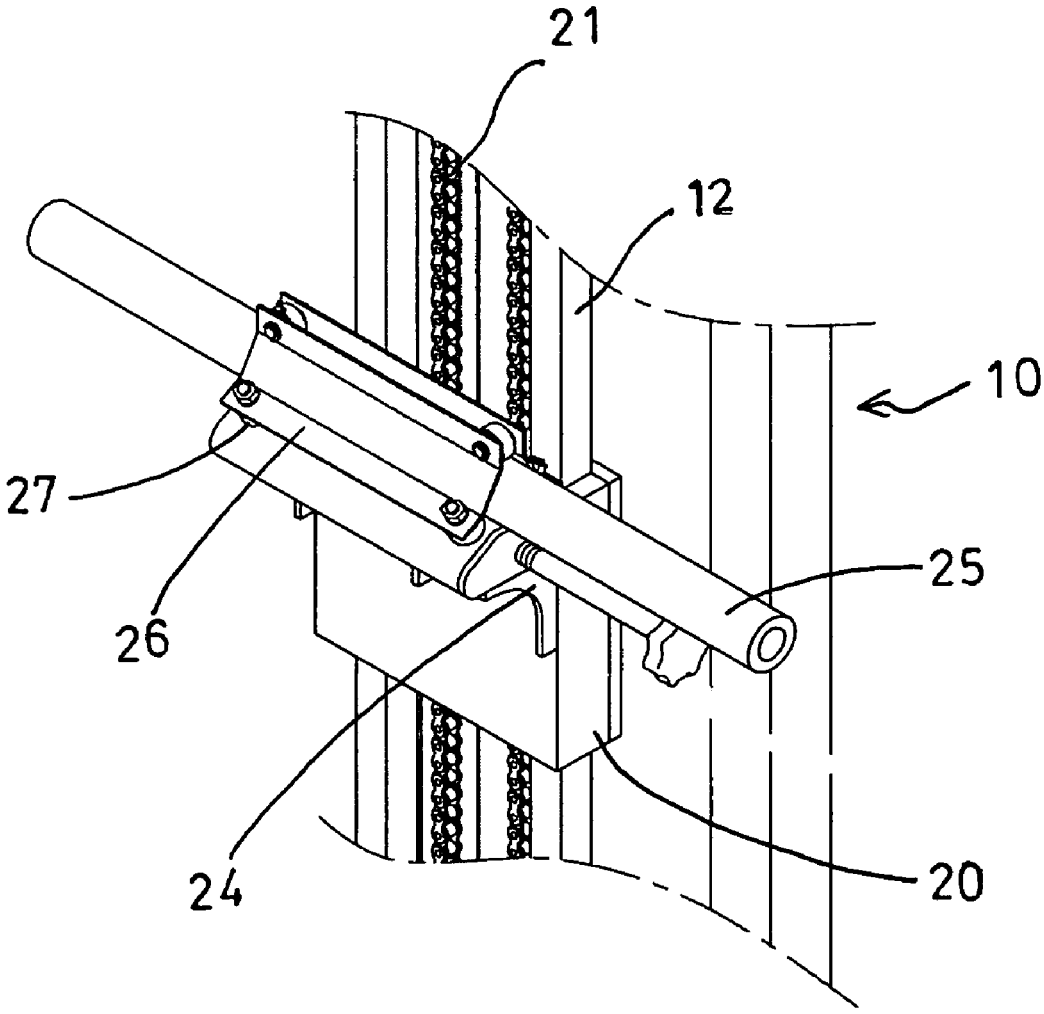
FIG. 4 is an enlarged partial perspective view of the sander device.
Figure 5:
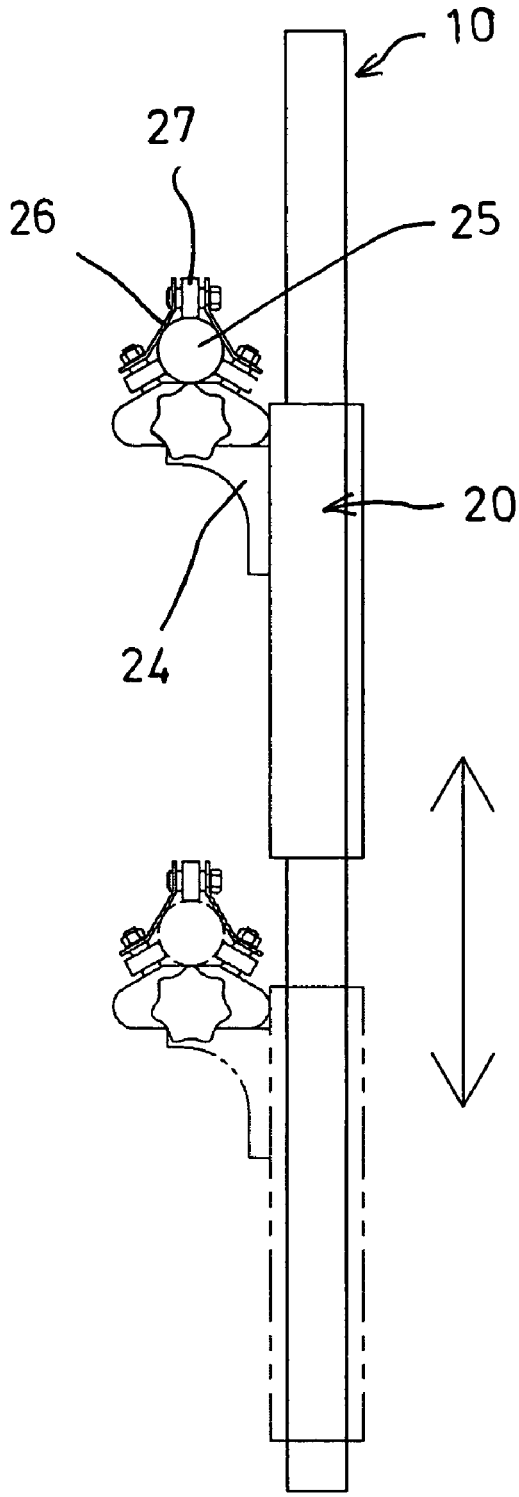
FIG. 5 is an enlarged partial plan schematic view illustrating the operation of the sander device.
Figure 6:
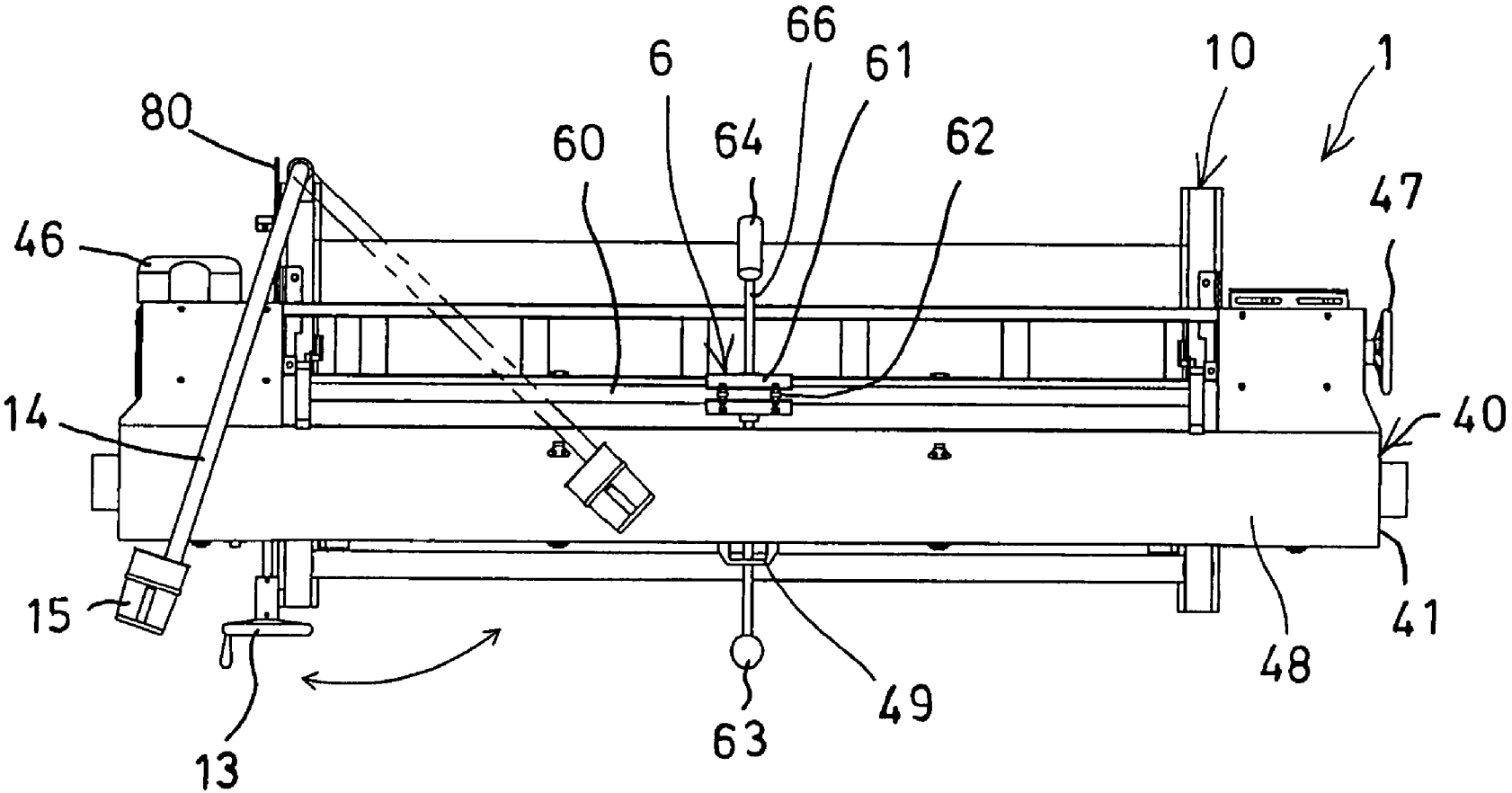
FIG. 6 is a top plan schematic view of the sander device.
Figure 13:
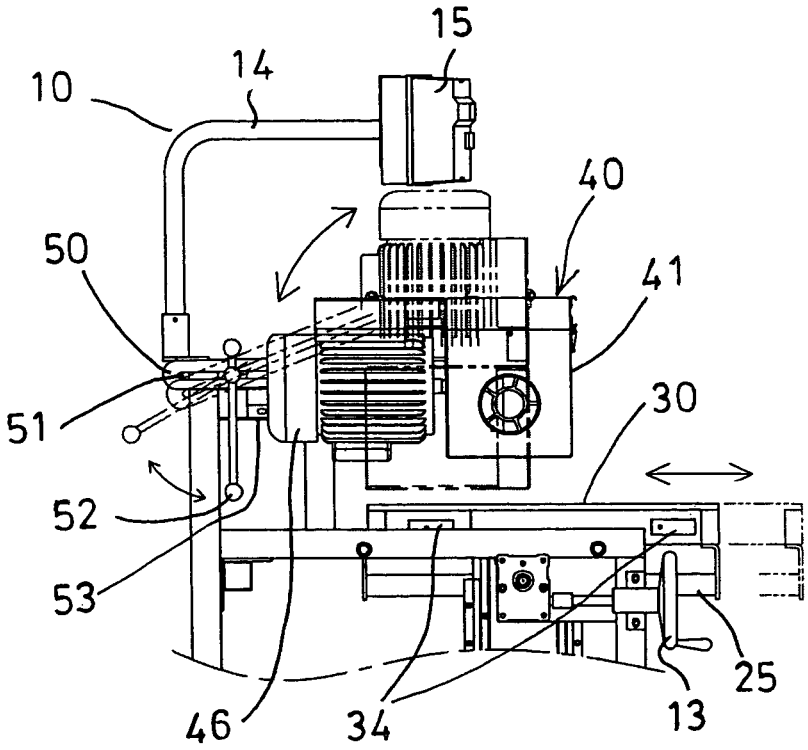
FIGS. 13, 14 are partial side plan schematic views similar to FIGS. 9 and 10 illustrating the folding or rotating operation of the sander device.
Figure 14:
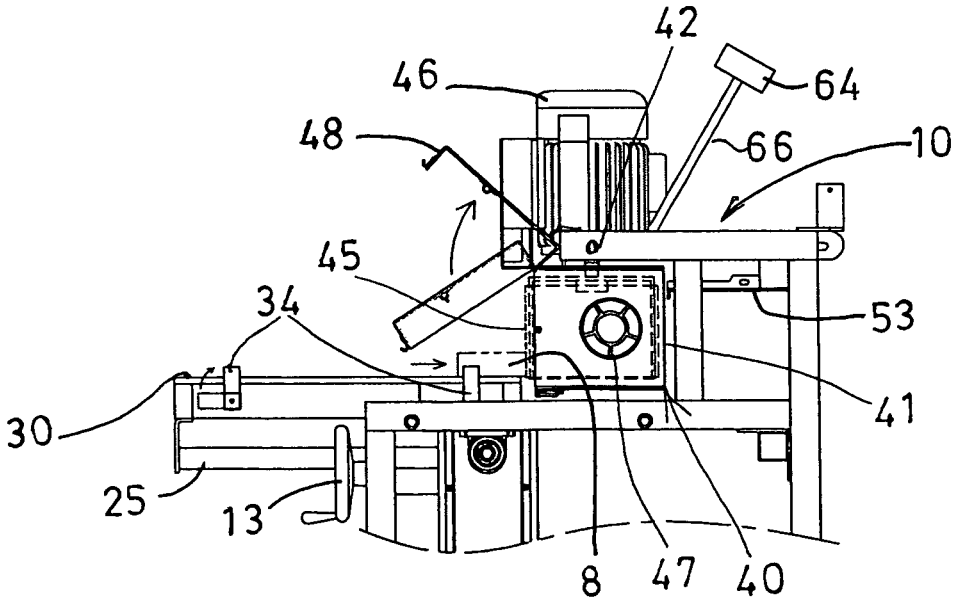
Figure 15:
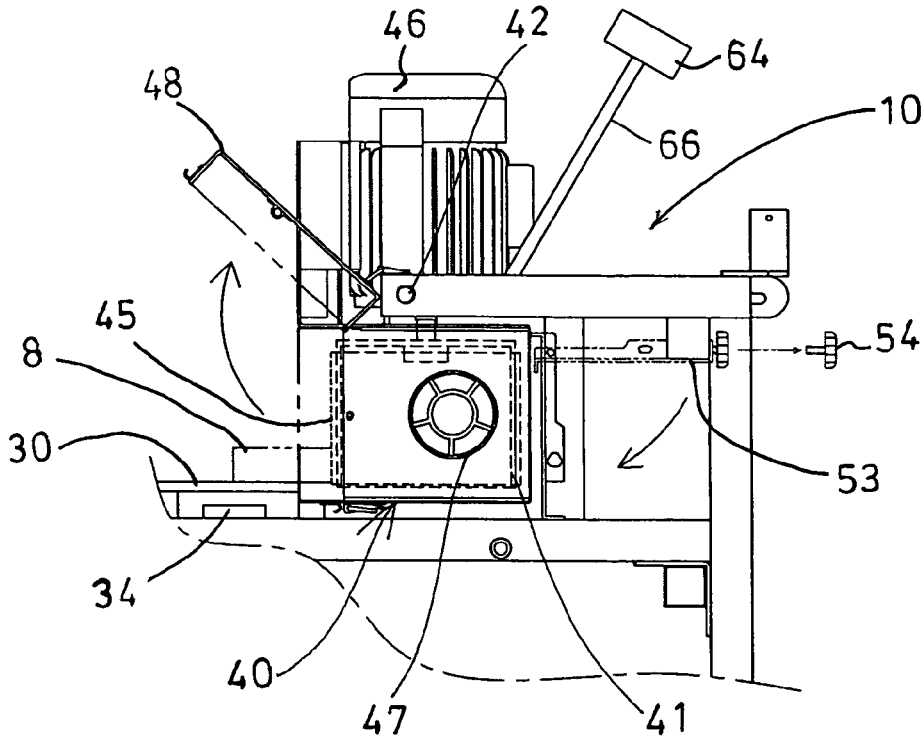
FIGS. 15, 16 are partial side plan schematic views similar to FIGS. 13 and 14 illustrating the operation of a shield for the sander device.
Figure 16:
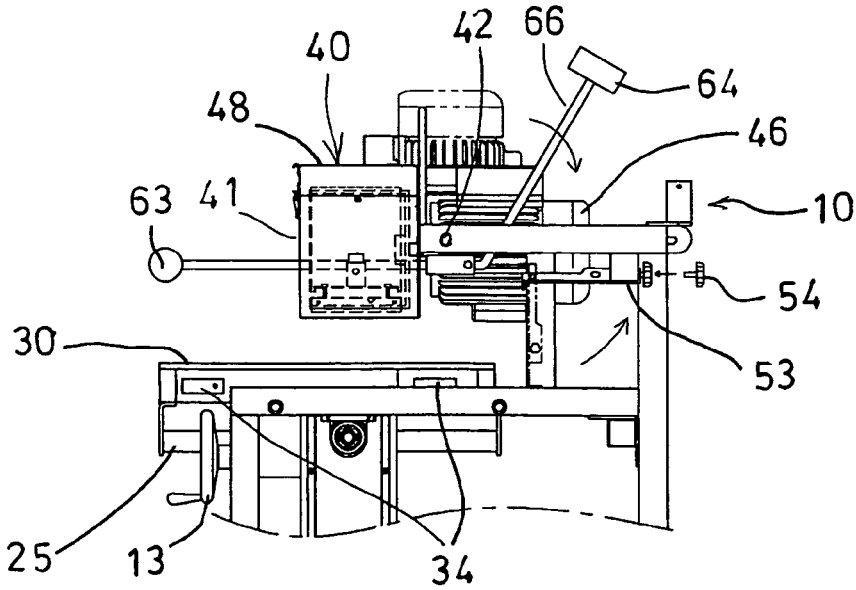

As shown in FIGS. 1-3, the housing 41 includes a cover 48 hinged to the upper portion of the housing 41, and a hand grip 49 attached to the cover 48 for rotating the cover 48 relative to the housing 41, and for opening the sanding belt 45 (FIGS. 14-15) and for allowing the sanding belt 45 to be exposed and to sand or grind the work pieces 8 when the sanding belt 45 is located at the vertical position. As shown in FIGS. 1-3 and 13, a lever 50 is hinged to the housing 41 and includes an oblong hole or channel 51 formed therein, and a fastening device 52 is attached to the supporting base 10 and engaged with the channel 51 of the lever 50 for selectively or adjustably securing the housing 41 to the supporting base 10 at either the horizontal position (FIGS. 1-3, 6-12) or the vertical position (FIGS. 13-15). A shield 53 may further be provided and pivotally hinged or secured to the supporting base 10 with a fastener 54 which may release the shield 53 for allowing the shield 53 to be rotated relative the supporting base 10 and to selectively cover or shield the opened bottom portion of the housing 41 or of the sanding belt 45 when the sanding belt 45 is located at the vertical position (FIGS. 14-15).

Figure 11:
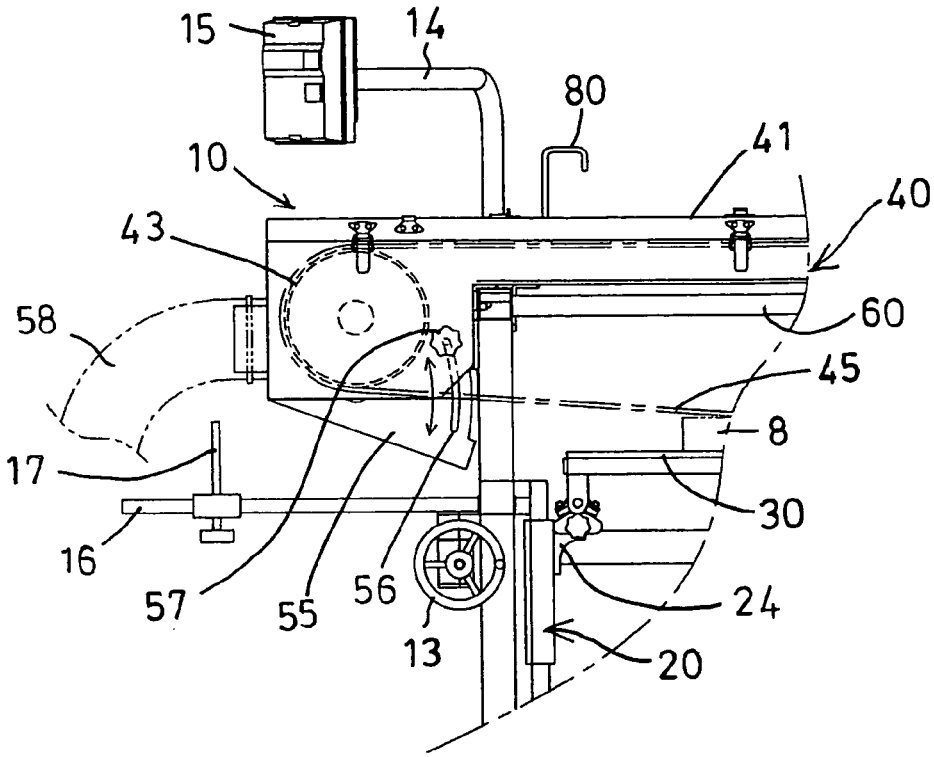
FIGS. 11, 12 are partial front plan schematic views illustrating the operation of the hood for the sander device.
Figure 12:
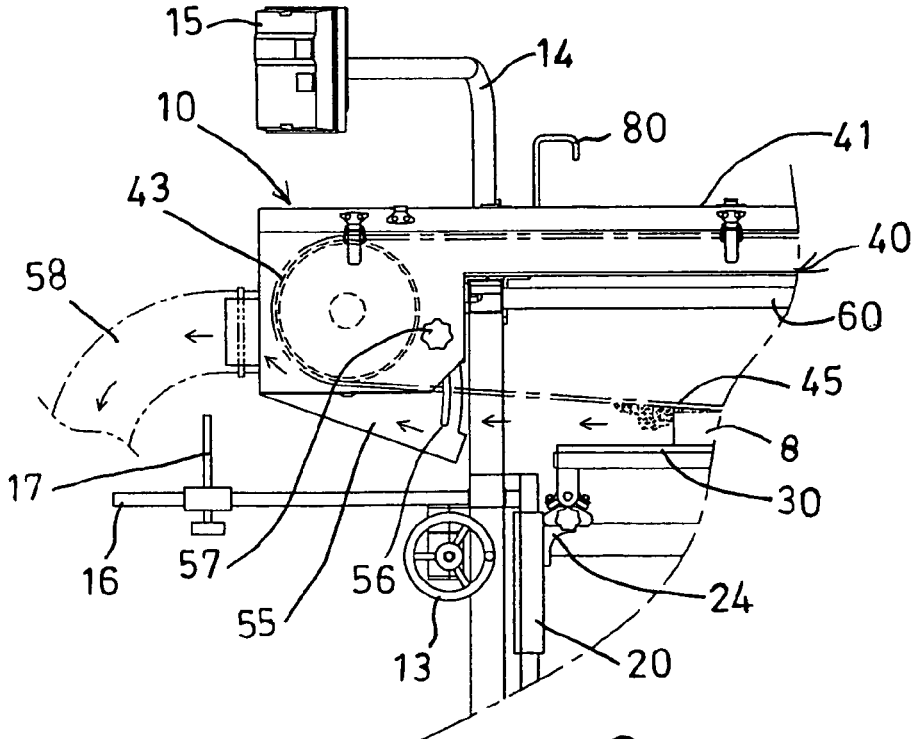

As shown in FIGS. 1-2 and 11-12, the housing 41 may further include a hood 55 provided and pivotally hinged or secured to either of the side portions of the housing 41, and an oblong hole or curved groove 56 formed in the hood 55, and another fastener 57 attached to either of the side portions of the housing 41 and engaged with the curved groove 56 of the hood 55 for selectively or adjustably securing the hood 55 to the housing 41, best shown in FIGS. 11-12, and for suitably covering or shielding the side portions of the housing 41. One or more hoses 58, 59 may further be attached or coupled to the side portions of the housing 41 (FIGS. 7-8, 11-12, 17) and coupled to a vacuum source (not shown) for vacuuming or drawing the sand dusts that may be generated during the sanding operations.

Figure 7:
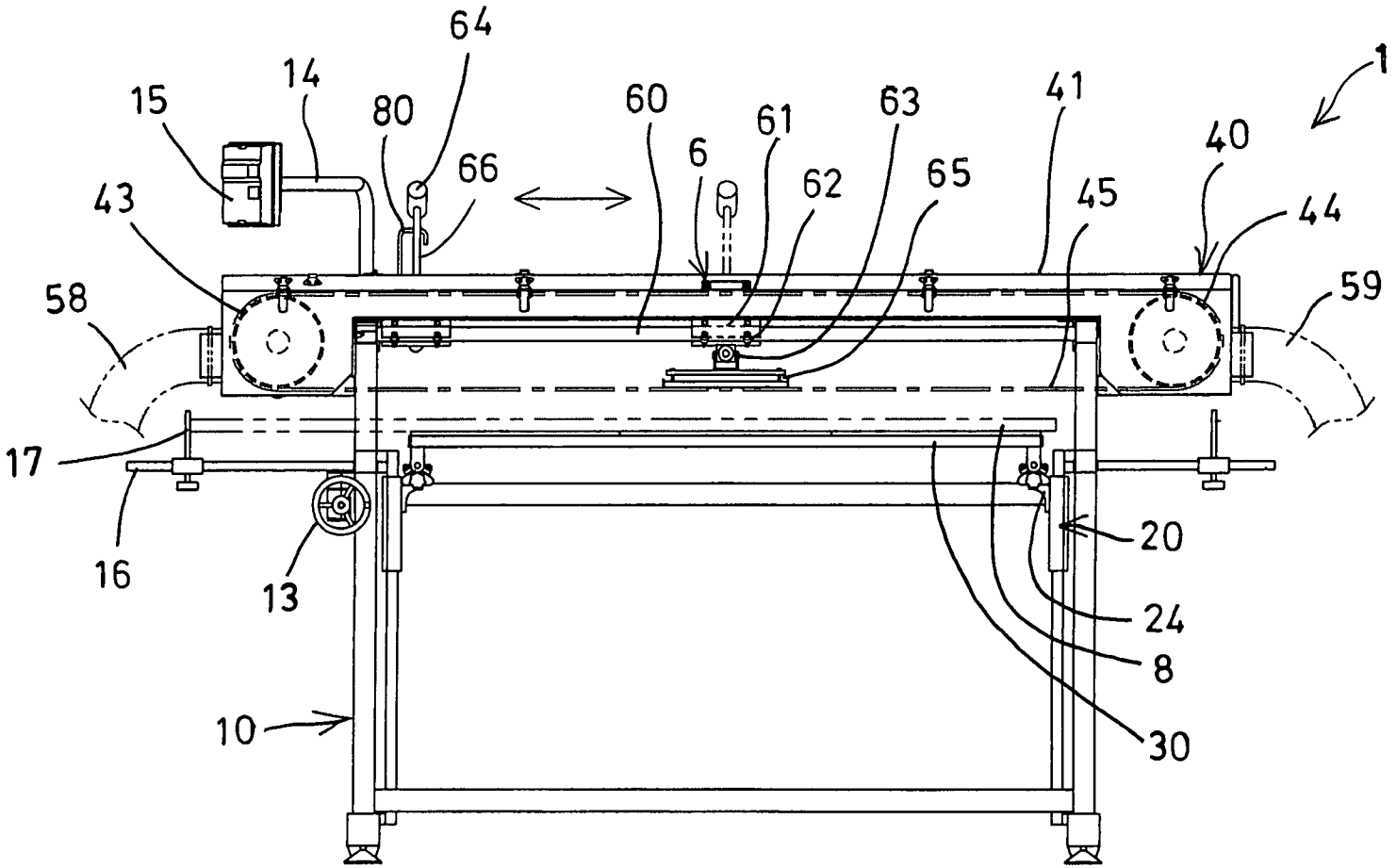
FIG. 7 is a partial front plan schematic view of the sander device.
Figure 8:
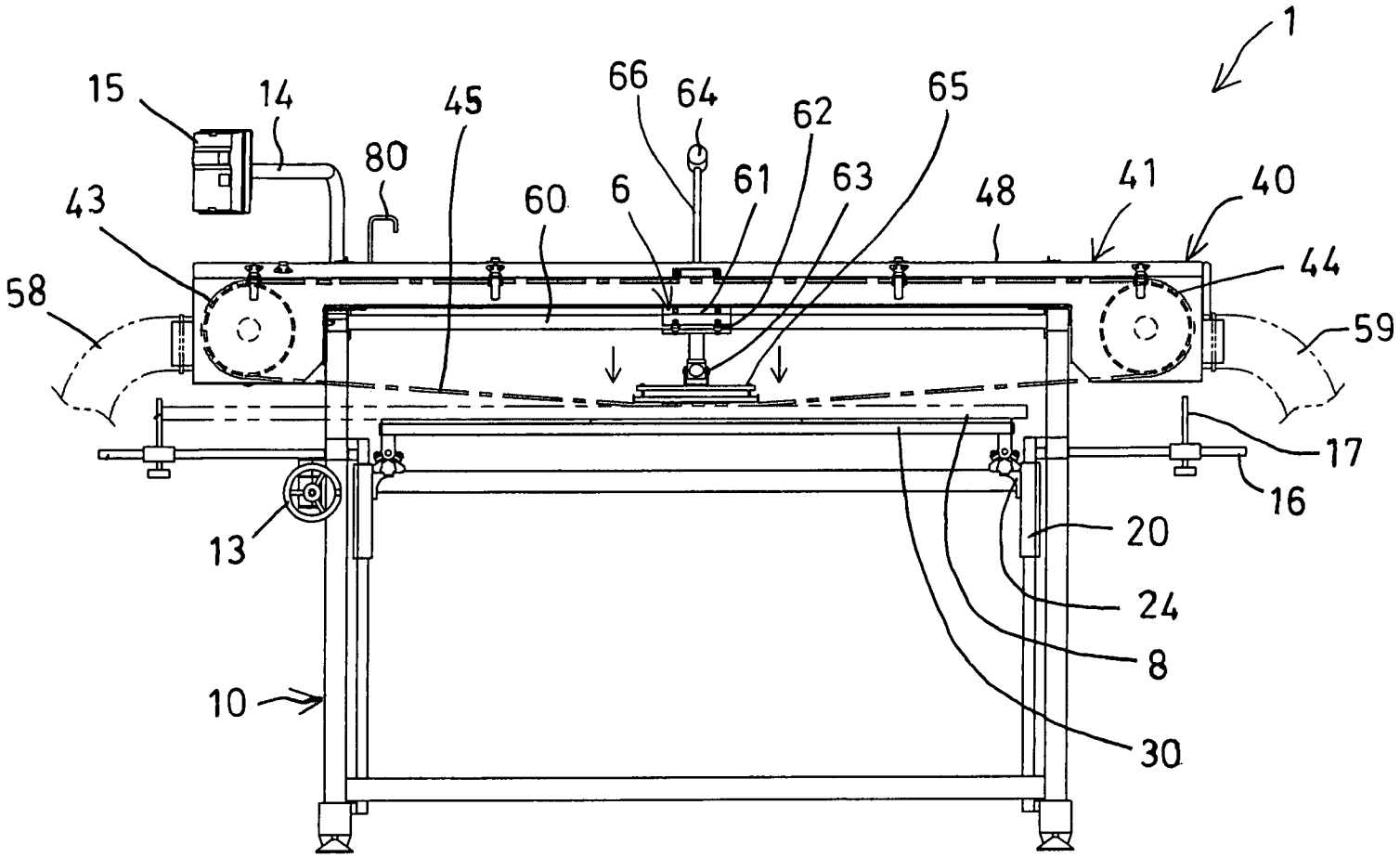
FIG. 8 is a partial front plan schematic view similar to FIG. 7, illustrating the operation of the sander device.
Figure 9:
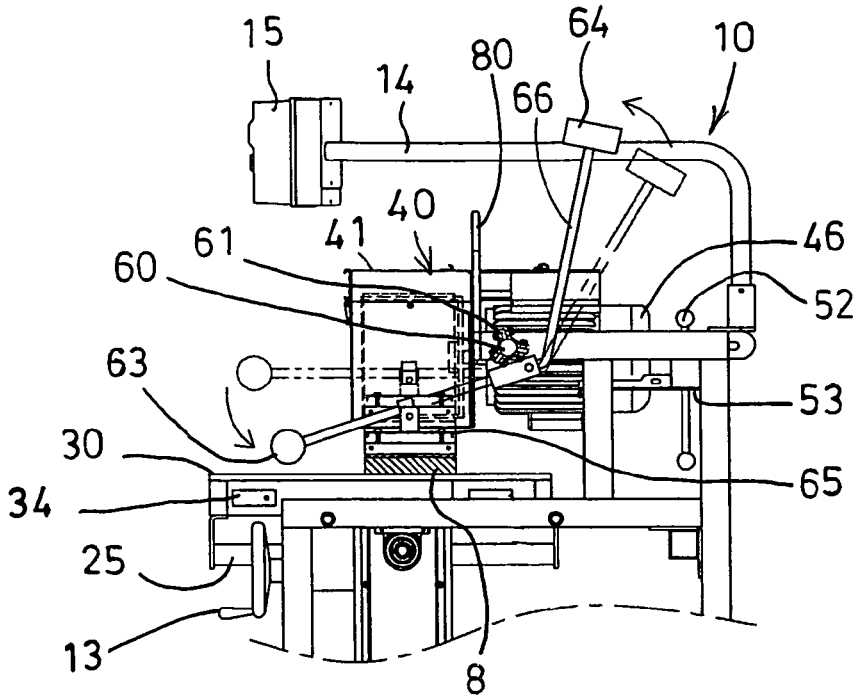
FIGS. 9, 10 are partial side plan schematic views illustrating the sanding operation of the sander device.
Figure 10:
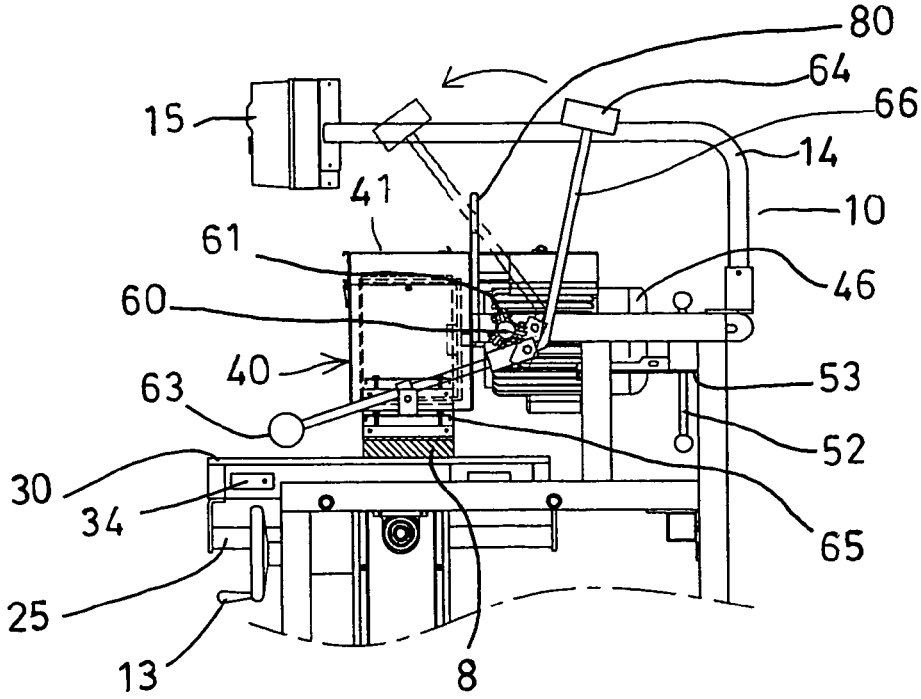

As shown in FIGS. 6-10, a pressing or actuating means or device 6 may further be provided and attached the housing 41, and includes a longitudinal shaft 60 disposed and attached to the housing 41, a sliding member 61 slidably attached to the shaft 60 with one or more bearings 62, an arm 63 pivotally hinged or secured to the sliding member 61 and extended through the endless driving belt 45, and an actuating or pressing member 65 pivotally hinged or secured to the arm 63 for being moved to engage with the driving belt 45 and for selectively forcing or pressing the driving belt 45 to sand or grind the work pieces 8 (FIG. 8). The arm 63 includes a weight member 64 attached to a rear extension 66 for selectively elevating and disengaging the actuating or pressing member 65 from the driving belt 45 (FIG. 16) and for allowing the sanding belt 45 to be selectively forced to engage with the work pieces 8 by the user with the actuating or pressing member 65 (FIGS. 7-10).

Figure 17:
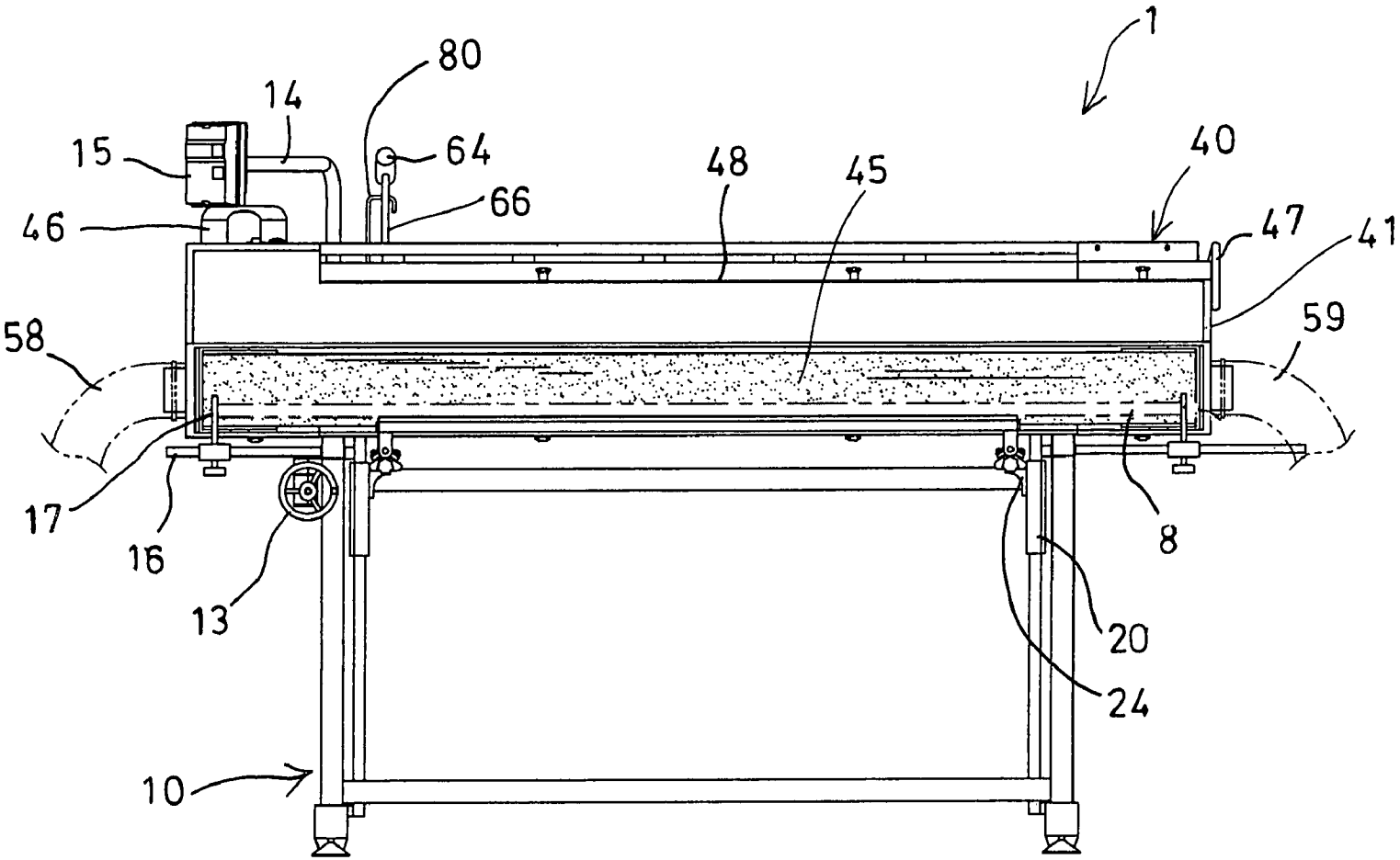
FIG. 17 is a partial front plan schematic view illustrating the sanding operation of the sander device when the sanding belt is rotated or adjusted to a vertical position.

In operation, as shown in FIG. 7, the actuating or pressing member 65 may be disengaged from the driving belt 45 by the weight member 64 and/or the extension 66, but may be forced to engage with the driving belt 45 in order to actuate the driving belt 45 to sand or grind the work pieces 8 with the arm 63. A hook or retainer 80 may further be provided and attached to the housing 41 for selectively engaging with the extension 66 of the arm 63 and for anchoring or positioning the arm 63 to the housing 41 (FIGS. 7, 10, 17) and for elevating and disengaging the actuating or pressing member 65 from the driving belt 45 and for preventing the sanding belt 45 from being forced to engage with the work pieces 8 by the actuating or pressing member 65 inadvertently, particularly when the sanding belt 45 is rotated to and located at the vertical position (FIG. 17).

It is to be noted that the sanding belt 45 may be rotated and adjusted relative to the supporting base 10 between the horizontal position and the vertical position for allowing the sanding belt 45 to selectively sand or grind the upper portion of the work pieces 8 or the rear or the side portion of the work pieces 8. In both situations or positions, the table 30 may also be moved up and down relative to the supporting base 10 by the adjusting means or device 20, and may also be moved forwardly and rearwardly relative to the supporting base 10 with the poles 25 and the handle 32 for suitably moving or supporting the work pieces 8 relative to the supporting base 10 and the sanding belt 45. The typical belt sander devices failed to provide a sanding belt that may be rotated and adjusted relative to the supporting base 10 between the horizontal position and the vertical position, and simultaneously a table 30 for suitably moving or supporting the work pieces 8 relative to the supporting base 10 and the sanding belt 45.

Accordingly, the sander device in accordance with the present invention includes a sanding belt adjustable between a horizontal position and a vertical position, and a feeding table for supporting and/or feeding the work pieces through the sanding belt when the sanding belt is either in the horizontal position or in the vertical position.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A sander device comprising:

a supporting base, a housing pivotally attached to said supporting base and rotatable relative to said supporting base between a horizontal position and a vertical position, a driven roller and an idle roller rotatably disposed in said housing, and an endless driving belt engaged over said driven roller and said idle roller, and a driving motor coupled to said driven roller for rotating and driving said sanding belt to sand a work piece, said driving belt also rotatable relative to said supporting base between said horizontal position and said vertical position together with said housing, an actuating device attached said housing for selectively forcing and pressing said driving belt to sand the work piece, a table for supporting the work piece, and means for moving and supporting said table and the work piece relative to said sanding belt and said supporting base when said driving belt is located at either said horizontal position or said vertical position.

2. The sander device as claimed in claim 1, wherein a shield is pivotally hinged to said supporting base and rotatable relative said supporting base to selectively cover and shield said sanding belt when said sanding belt is located at said vertical position.

3. The sander device as claimed in claim 1, wherein said housing includes a cover hinged to said housing and rotatable relative to said housing for selectively opening and exposing said sanding belt and for allowing said sanding belt to sand the work piece when said sanding belt is located at said vertical position.

4. The sander device as claimed in claim 1, wherein said housing includes at least one hose coupled to said housing.

5. The sander device as claimed in claim 4, wherein said housing includes at least one hood hinged to said housing for covering and shielding one side portion of said housing.

6. The sander device as claimed in claim 5, wherein said at least one hood includes a curved groove formed therein, and a fastener attached to said housing and engaged with said curved groove of said at least one hood for adjustably securing said at least one hood to said housing.

7. The sander device as claimed in claim 1, wherein said moving means includes two followers slidably attached to said supporting base and movable up and down relative to said supporting base for supporting said table.

8. The sander device as claimed in claim 7, wherein said supporting base includes two chains attached thereto and coupled to said followers for moving said for lowers up and down relative to said supporting base.

9. The sander device as claimed in claim 8, wherein said supporting base includes two pairs of sprockets attached thereto and coupled to said chains, and a hand wheel rotatably attached to said supporting base and coupled to one of said sprockets for driving said chains and for moving said followers relative to said supporting base.

10. The sander device as claimed in claim 9, wherein a link is coupled between two of said sprockets for coupling said chains together.

11. The sander device as claimed in claim 9, wherein two casings are attached to said supporting base for receiving said sprockets and said chains.

12. The sander device as claimed in claim 7, wherein two poles are slidably attached to said followers and coupled to said table for allowing said table to be moved forwardly and rearwardly relative to said supporting base with said poles.

13. The sander device as claimed in claim 12, wherein said poles are slidably attached to said followers with at least one bracket and at least one roller.

14. The sander device as claimed in claim 1, wherein said table includes at least one stop attached to said table for engaging with the work piece and for anchoring the work piece to said table.

15. The sander device as claimed in claim 1, wherein said supporting base includes at least one rod attached to said supporting base for supporting a stop which may engage with the work piece for anchoring the work piece to said supporting base.

16. The sander device as claimed in claim 1, wherein said actuating device includes a shaft attached to said housing, a sliding member slidably attached to said shaft, an arm hinged to said sliding member and extended through said driving belt, and an actuating member hinged to said arm for being moved to engage with said driving belt.

17. The sander device as claimed in claim 16, wherein said arm includes a weight member attached to an extension of said arm for elevating and disengaging said actuating member from said driving belt.

18. The sander device as claimed in claim 17, wherein a retainer is attached to said housing for selectively engaging with said extension of said arm and for anchoring and positioning said arm to said housing.

* * * * *